US006076291A

United States Patent [19]

Jensen

[11] Patent Number: 6,076,291

[45] Date of Patent: Jun. 20, 2000

[54] SANDWICH-CONVEYOR

[75] Inventor: Jørn Munch Jensen, Bern, Switzerland

[73] Assignee: Ejnar Jensen & Son A/S, Ronne, Denmark

[21] Appl. No.: 09/145,830

[22] Filed: Sep. 2, 1998

[51] Int. Cl.[7] ..... D06F 67/04

[52] U.S. Cl. ..... 38/143

[58] Field of Search ..... 78/143, 102; 26/51, 26/78, 79; 271/259, 8.1, 34, 109

[56] References Cited

U.S. PATENT DOCUMENTS

| | | | |
|---|---|---|---|
| 3,464,131 | 9/1969 | McCabe | 38/143 |
| 3,473,244 | 10/1969 | Milone et al. | 38/44 X |
| 3,563,066 | 2/1971 | Bajak et al. | 38/143 |
| 5,079,867 | 1/1992 | Kober et al. | 38/8 X |

FOREIGN PATENT DOCUMENTS

| | | | |
|---|---|---|---|
| 2221226 | 1/1990 | Denmark | 38/143 |

*Primary Examiner*—Ismael Izaguirre

*Attorney, Agent, or Firm*—Finnegan, Henderson, Farabow, Garrett & Dunner, L.L.P.

[57] ABSTRACT

The invention relates to a method of advancing substantially rectangular pieces of cloth to a cloth treatment apparatus, such as a rotary ironer, whereby the piece of cloth is initially spread out and advanced in its spread-out state and at a given rate of conveyance between a subjacent conveyor and a superjacent conveyor that abut on the subjacent conveyor; and whereby folded edges, if any, on the frontmost and/or the rearmost border(s) of the piece of cloth, seen in the direction of conveyance of the subjacent conveyor, are completely or partially straightened in the plane of the piece of cloth prior to the piece of cloth entering said cloth treatment apparatus. The invention is characterised in that at least one of the folded edges on the front border and/or the rear border of the piece of cloth are completely or partially straightened by accomplishing, at least briefly, a difference in the respective rates of conveyance between the superjacent and the subjacent conveyors whereby the folded edge(s) are straightened due to the friction and the difference in rates of conveyance of the piece of cloth between the subjacent and/or the superjacent conveyor(s). The invention further relates to an apparatus for exercising the method.

14 Claims, 5 Drawing Sheets

SANDWICH-CONVEYOR

BACKGROUND OF THE INVENTION

1. Field of the Invention

The present invention relates to a method of conveying substantially rectangular pieces of cloth to a cloth treatment apparatus, such as a rotary ironer, whereby the piece of cloth is initially spread out and conveyed in its spread-out state and at a given rate of conveyance between a subjacent conveyor and a superjacent conveyor that abuts on the subjacent conveyor, and whereby folded edges, if any, on the frontmost and/or the rearmost border(s) of the piece of cloth, seen in the direction of conveyance of the subjacent conveyor, is/are completely or partially straightened in the plane of the piece of cloth prior to the piece of cloth entering said cloth treatment apparatus, eg a rotary ironer.

The invention further relates to an apparatus for exercising the method, said apparatus comprising a subjacent and a superjacent conveyor and means for operating said subjacent and superjacent conveyors, and wherein the subjacent and the superjacent conveyors abut on each other and are configured in such a manner that individual pieces of cloth can be advanced in their spread-out state there between with a frontmost and a rearmost border seen in the direction of conveyance of the piece of cloth, and wherein the apparatus comprises means for completely or partially straightening folded edges, if any, on the frontmost and/or the rearmost border(s) of said piece of cloth, seen in the direction of conveyance of the piece of cloth, in such a manner that the folded edges are completely or partially straightened in the plane of said piece of cloth prior to said piece of cloth entering said cloth treatment apparatus, such as a rotary ironer.

2. Description of the Related Art

Such apparatuses, as known ia from DE 38 25 646 C2, are most often used in industrial laundries where the substantially rectangular pieces of cloth are initially washed and subsequently dried, following which they are introduced into an apparatus configured for spreading the pieces of cloth and transferring them to a conveyor that conveys the pieces of cloth in their spread-out state to a rotary ironer where the piece of cloth is further dried but where, in particular, the piece of cloth is ironed.

Thus, DE 38 25 646 describes an apparatus comprising a superjacent and a subjacent belt or tape conveyor, and wherein the superjacent and the subjacent belt or tape conveyors are arranged so as to abut on each other and thereby pull the piece of cloth in between the two conveyors. However, in this process it often occurs that the piece of cloth, although being substantially completely spread out, has folded edges either on the top side or the underside of the piece of cloth. Therefore the known apparatus according to DE 38 25 646 features means for straightening folded edges on the front border of the piece of cloth, seen the in the direction of conveyance of the conveyors, said means consisting of a feed conveyor arranged before the above-mentioned belt or tape conveyors, said feed conveyor being provided with a braking device arranged for briefly braking the feed conveyor during the period of time when the front border of the piece of cloth is just entering between the superjacent and the subjacent belt or tape conveyors. In this manner, folded edges on the front border of the piece of cloth, if any, are straightened prior to the piece of cloth passing the superjacent or the subjacent belt or tape conveyor.

However, it is a problem with this prior art that the straightening presupposes at least a brief braking of the piece of cloth, and that only the front borders of said piece of cloth can be straightened, the apparatus being unsuitable eg for straightening the rear borders.

SUMMARY OF THE INVENTION

In the light of this, it is the object of the present invention to provide a relatively simple apparatus that can advantageously be used for the straightening of the front borders as well as the rear borders of a piece of cloth.

In accordance with the present invention this is obtained by the method whereby at least one of the folded edges on the front border and/or the rear border of the piece of cloth is/are completely or partially straightened by featuring at least a brief difference in the respective rates of conveyance of the superjacent and the subjacent conveyors, in such a manner that the folded edge(s) can be straightened due to the friction and the difference in rates between the piece of cloth between the subjacent and/or the superjacent conveyor(s); and by use of the apparatus, wherein the means for completely or partially straightening folded edges, if any, on the frontmost and/or the rearmost border(s) of the piece of cloth are provided by the means for operating the subjacent and the superjacent conveyors being arranged to cause the subjacent and the superjacent conveyors, at least briefly, to be advanced at different rates.

However, the present invention is particularly suitable for straightening folded edges at the rear border of the piece of cloth, said folded edges which are folded across the piece of cloth at the rear border of the piece of cloth being straightened completely or partially by the piece of cloth being pulled forwards at a rate of conveyance that corresponds essentially to the rate of conveyance of the subjacent conveyor, and at least briefly providing a reduced rate of conveyance for the superjacent conveyor compared to the rate of conveyance of the piece of cloth.

Straightening of folded edges, if any, at the frontmost border of the piece of cloth, seen in the direction of conveyance of the subjacent conveyor, can subsequently advantageously be accomplished by braking the piece of cloth relative to the rates of conveyance of the superjacent and/or the subjacent conveyors during that period of time when the front border of the piece of cloth is pulled in between the subjacent and the superjacent conveyors.

As regards straightening of folded edges that are folded underneath the piece of cloth at the rear border of the piece of cloth seen in the direction of conveyance of the piece of cloth, this process can advantageously be carried out by the rear border of the piece of cloth being, at a point in time when the rear border is situated between the superjacent and the subjacent conveyors, conveyed past a brush device arranged below the subjacent conveyor.

In order to avoid to the widest extent possible that, following straightening, the folded edges on the piece of cloth return to their back-folded state, at least those edges on the piece of cloth that are straightened in the plane of the piece of cloth are subsequently advantageously maintained in their straightened state between the superjacent and the subjacent conveyors.

In this context, it is possible, at least at the front and/or the rear border(s) of the piece of cloth, to emboss the piece of cloth transversally to the front and/or rear borders of the piece of cloth while the border is situated between the superjacent and the subjacent conveyors.

Since the transfer of the piece of cloth to a subsequent rotary ironer presupposes that the piece of cloth is transferred very accurately, it is advantageous if, following embossing of the front border and/or the rear border, the piece of cloth is secured to the top surface of the subjacent conveyor by means of a subatmospheric pressure supplied from the underside of the subjacent conveyor to its top surface.

According to a preferred embodiment of the invention, a rear border detection device is provided for detecting the presence of the rear border of a piece of cloth between the subjacent and the superjacent conveyors; and means for operating the superjacent conveyor at a lower rate of conveyance than the rate of conveyance with which the subjacent conveyor is advanced upon detection of the rear border of the piece of cloth by the rear border detection device, thereby ensuring that folded edges, if any, at the rear edge of the piece of cloth are straightened, said folded edges extending on the top side of the piece of cloth.

The apparatus can further comprise a brush device arranged below the subjacent conveyor, said brush device being displaceable between a first, inactive position and a second, active position in which it extends from the underside of the subjacent conveyor to its top surface; and wherein means are provided for shifting the brush device to its second, active position upon detection of the rear border of the piece of cloth by the rear border detection device in such a manner that folded edges, if any, at the rear border of the piece of cloth are straightened, said folded edges extending underneath the piece of cloth.

Further advantageously, a feed conveyor is arranged before the subjacent and the superjacent conveyors, seen in the direction of conveyance of the piece of cloth, intended for advancing pieces of cloth to the subjacent and the superjacent conveyors; and the apparatus further comprises a front border detection device arranged with a view to detecting the presence of the front border of a piece of cloth between the subjacent and the superjacent conveyors; and means are provided that will, as a consequence of the front border of the piece of cloth being detected by the front border detection device, operate the feed conveyor, at least briefly, at a reduced rate of conveyance compared to the rate of conveyance of the subjacent conveyor whereby folded edges, if any, at the front border of the piece of cloth are straightened.

In order to ensure that the folded edges of the piece of cloth do not return to their original, folded state following straightening, it is further preferred that the apparatus also comprises an embosser device arranged after the means for complete or partial straightening of folded edges, if any, on the front and/or rear border(s) of the piece of cloth, seen in the direction of conveyance of the piece of cloth, said embosser device being arranged for embossing the piece of cloth in such a manner that the embossed patterns extend at least across and substantially transversally to those edges of the piece of cloth that have been straightened.

For the same reason, it is preferred that the subjacent conveyor extends farther than the superjacent conveyor, seen in the direction of conveyance of the piece of cloth, and that, at least in the area where the subjacent conveyor extends beyond the superjacent conveyor, means are provided for establishing a subatmospheric pressure from the underside of the subjacent conveyor towards the top surface thereof.

In this context, the subjacent conveyor can advantageously be a tape conveyor comprising a number of tapes arranged adjacently and spaced apart, and the tapes are preferably provided with perforations with a view to transferring said subatmospheric pressure from the underside of the subjacent conveyor to the top surface thereof.

BRIEF DESCRIPTION OF THE PREFERRED EMBODIMENTS

The invention will now be described in further detail with reference to the drawings, wherein.

Figure 1:
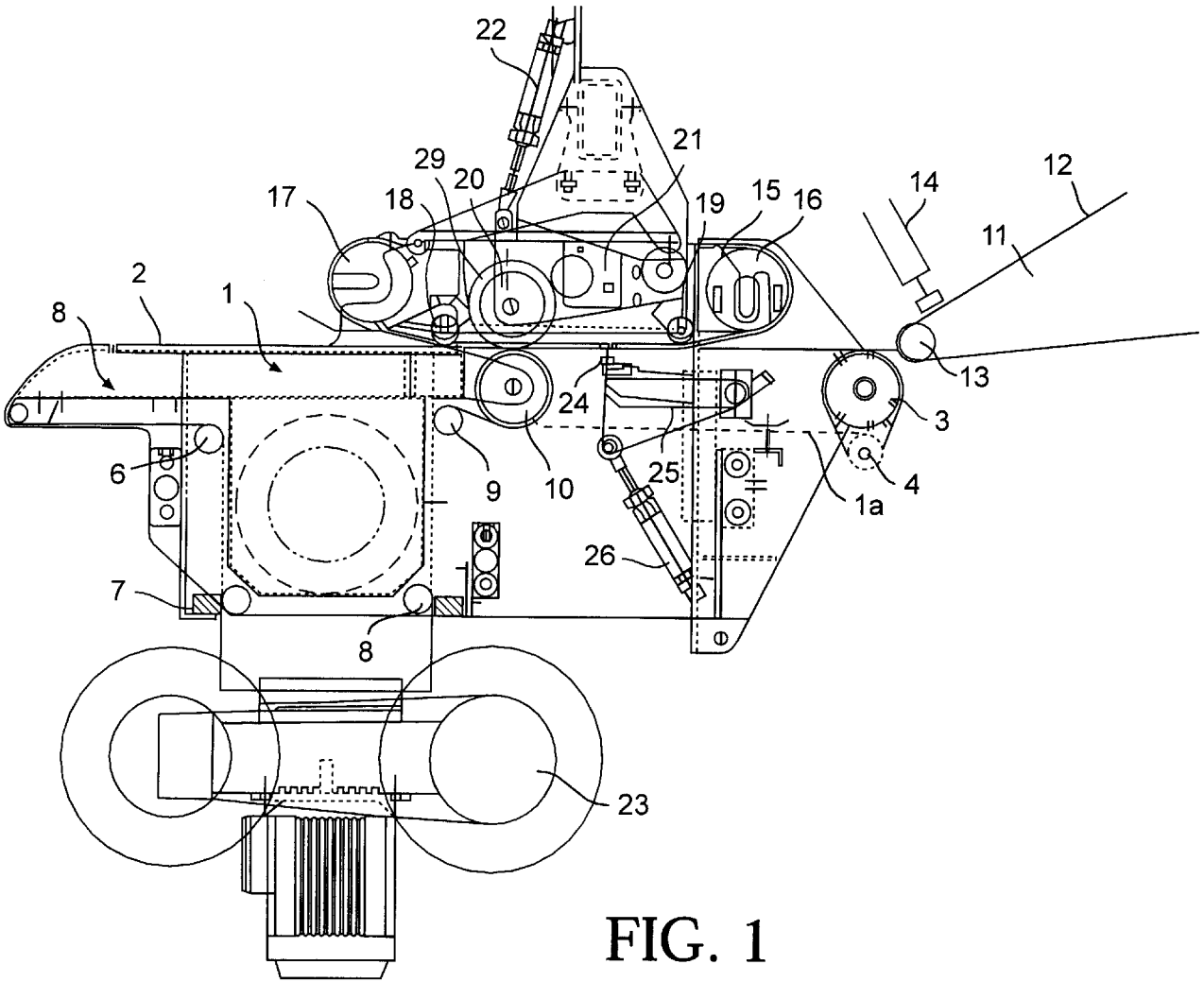
FIG. 1 is an explanatory sketch of an apparatus according to the invention, seen from the side.

Thus, FIG. 1 is an explanatory sketch showing the apparatus according to the present invention. The apparatus is shown in a side view. Thus, the apparatus consists of a subjacent conveyor 1 and a superjacent conveyor 2. The subjacent conveyor 1 comprises a number of tape belts 1*a* that extend from a drum 3 that are caused to rotate by a chain drive 4, and past a rubber roller 10, and then a vacuum box 5 that supplies vacuum to the underside of the tape belts by means of a suction device 23, and from here the tape belts extend past the rollers 6,7,8,9 and past the underside of the rubber roller 10 and back to the drum 3.

At the one end of the subjacent conveyor 1, a feed conveyor 11 is arranged which also comprises a number of tape belts 12 that extend beyond the roller 13, and wherein a braking device 14 is arranged above the feed conveyor in the form of a piston that can be activated to press against the tape strips 12 in order to hereby effectively brake a piece of cloth which is advanced from the feed conveyor 11 to the subjacent conveyor 1 by simultaneously braking the feed conveyor 11 and activating said braking device.

Above the subjacent conveyor 1, an upper conveyor 15 is arranged which also comprises a number of parallel tape belts that extend around the two drums 16,17 and beyond the rollers 18 and 19 and the underside of a roller 20.

The roller 20 is displaceably arranged in a substantially vertical direction on a swing fitting 21, and an actuator in the form of a pneumatic cylinder 22 is arranged for moving the roller 20 upwards and downwards.

The roller 20 is provided with a number of discs 29 that are so arranged that they share centre of rotation with the roller 20 and so that, in the lowermost position of the roller, they extend between the individual tape belts on the subjacent as well as on the upper conveyor 15 where they abut on the top surface of the rubber roller 10.

Below the subjacent conveyor 1 a brush-like device 24 arranged on a swing fitting 25 such that the brush-like device can be shifted upwards and downwards by means of an actuator in the form of a pneumatic cylinder 26 such that the brushes on the brush-like device 24 extend between the spaces between the tape strips 2 on the subjacent conveyor.

Figure 2:
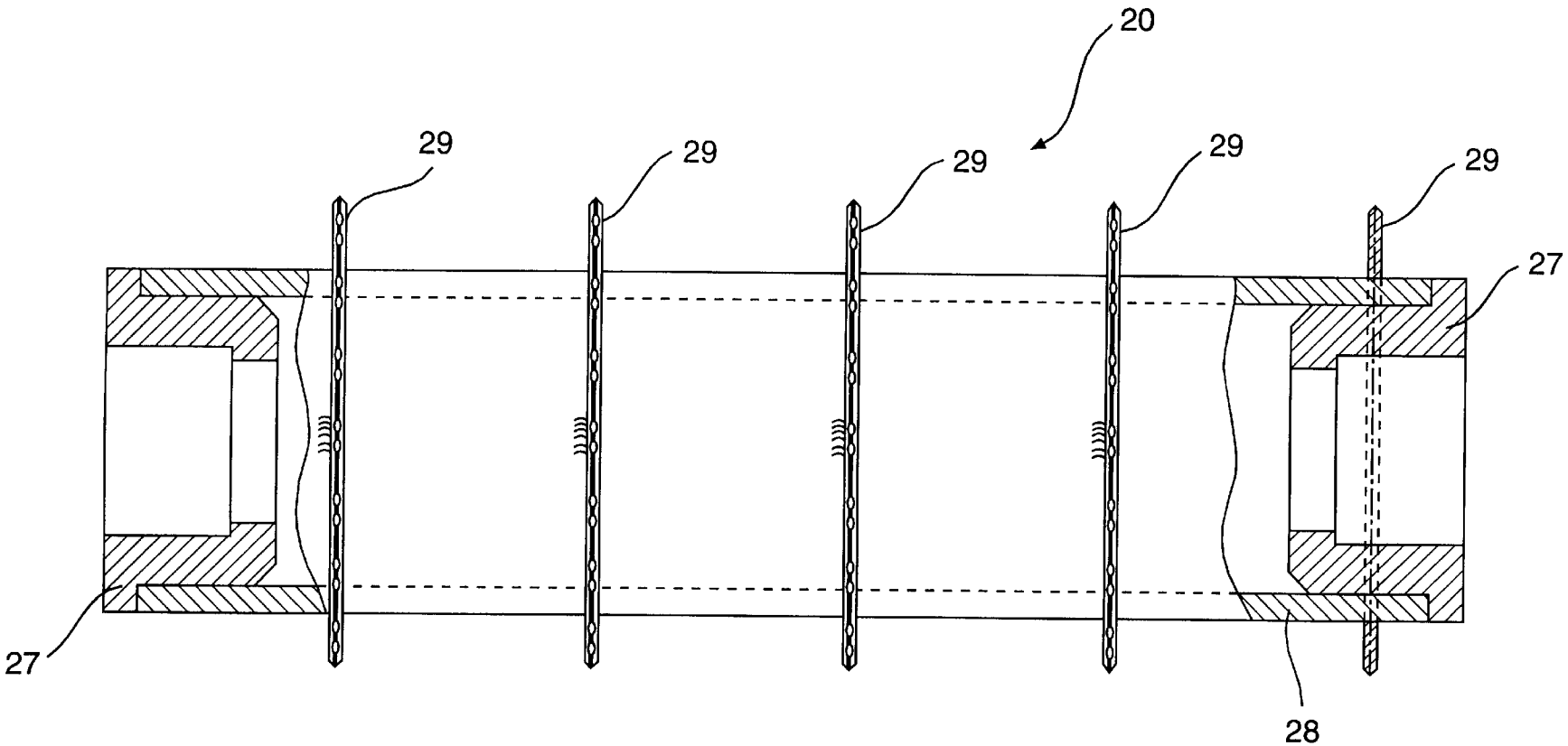
FIG. 2 is a partial sectional view illustrating the embosser roller according to FIG. 1, seen in a front view.

Now, FIG. 2 is a detailed view of the roller 20, and it will appear that the roller 20 is a conventional roller construction with roller fronts 27, and a roller shroud 28. In accordance with the invention, the roller is, in this preferred embodiment and as stated above, provided with a number of discs 29, each of which is secured to the roller. Hereby the roller is, as will appear from the description that follows, configured as an embosser roller which is able to generate parallel indentations or embossed patterns in the surface of a piece of cloth which is conveyed through the apparatus shown in FIG. 1.

Figure 3:
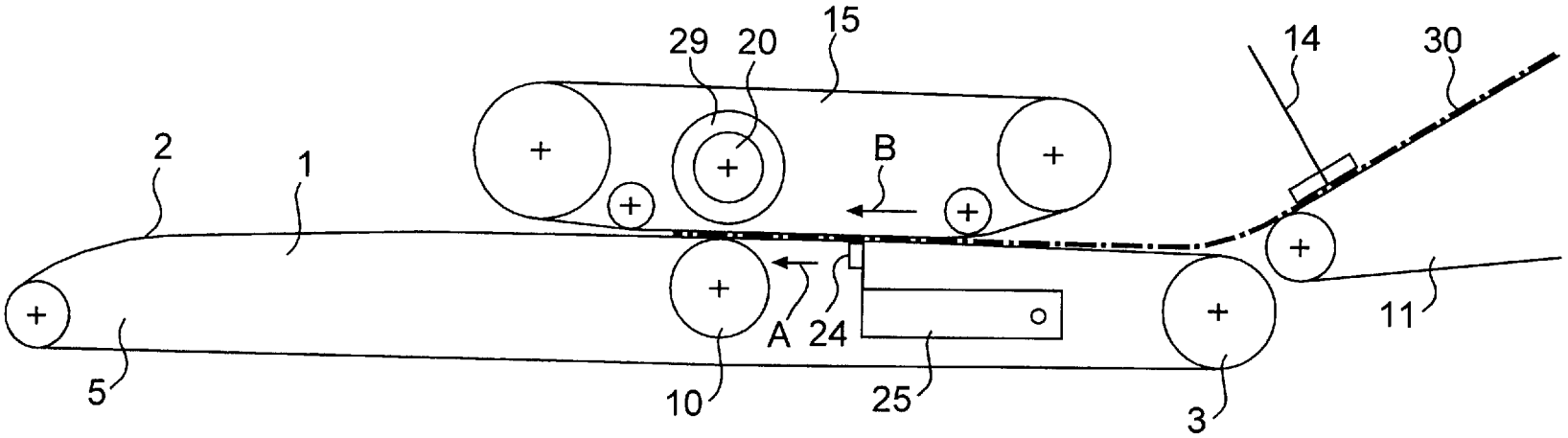
FIGS. 3 through 5 are explanatory sketches illustrating three different process steps in the apparatus according to FIG. 1.
Figure 4:
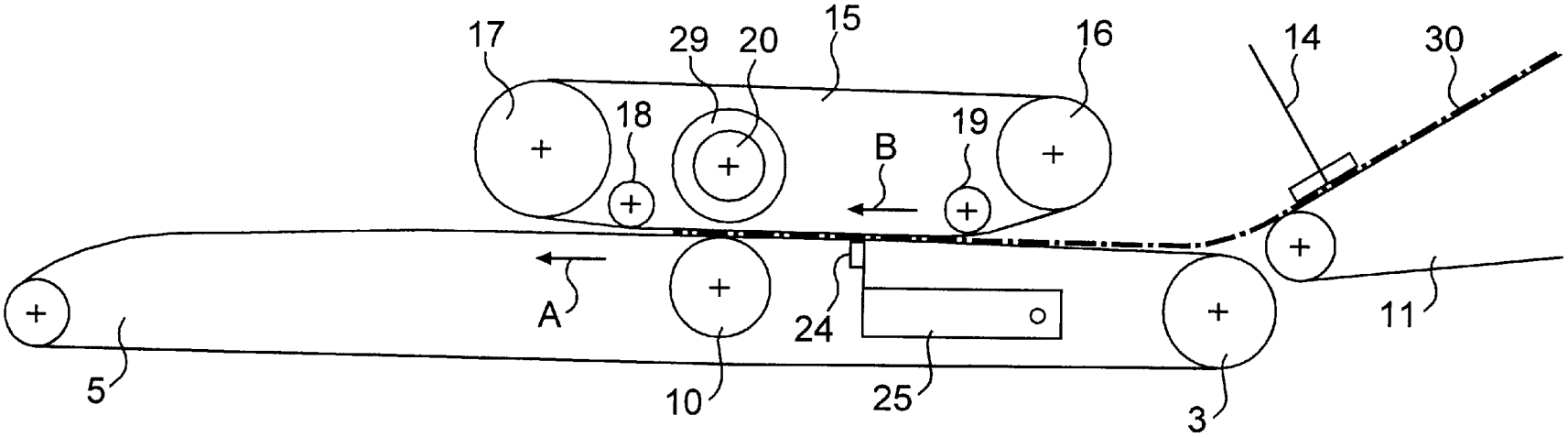
Figure 5:
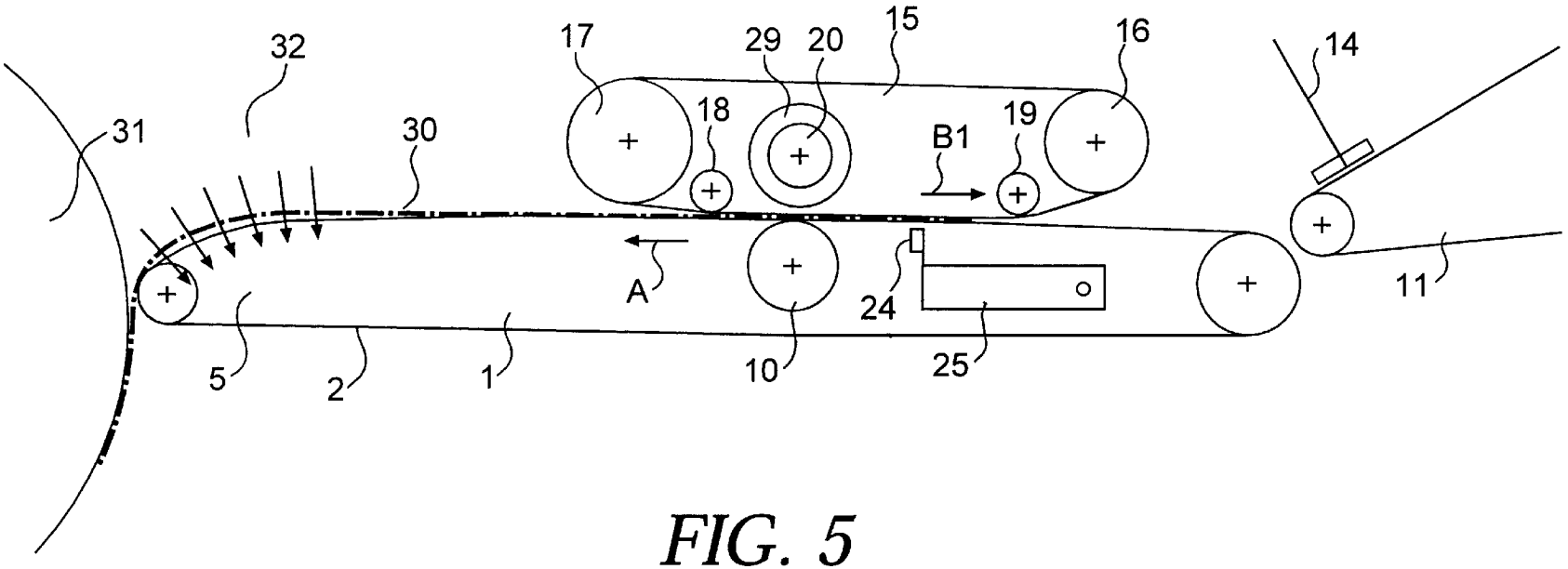

With particular reference to FIGS. 3 through 5, the apparatus shown in FIG. 1 will now be explained with reference to various process steps during advancing of a piece of cloth from the feed conveyor 11 to a cloth treatment apparatus in the form of a dryer roller arranged opposite the subjacent conveyor 1 at the end where the subjacent conveyor has a vacuum box 5.

Thus, FIG. 3 illustrates a process step in which a piece of cloth, shown with a bold dash-dotted line, is advanced across the feed conveyor 11 and towards the subjacent conveyor, so far that the front border of the piece of cloth, seen in the direction of conveyance, is enclosed between the subjacent conveyor 1 and the upper conveyor 15.

In this situation, the feed conveyor 11 is briefly halted while the braking device 14 is simultaneously activated thereby reducing the speed of conveyance of the piece of cloth. During continued operation of the subjacent conveyor 1 as well as the upper conveyor 15 in direction of the arrows A and B, respectively, folded edges, if any at the front border 30 of the piece of cloth will be straightened.

Now, FIG. 4 illustrates a process step which, chronologically, follows the process step shown in FIG. 3, wherein the piece of cloth 30 has been advanced a further distance so far that the front border of the piece of cloth extends between the roller 20 and the rubber roller 10. Thereby the front border of the piece of cloth 30 will, as a consequence of the roller 20 being in this process step pressed against the rubber roller 10, be provided with embossed patterns from the discs 29 of the roller 20 whereby the edges that have been straightened on the front border of the piece of cloth will be provided with embossed patterns transversally to those folds that are still present, despite the previous straightening of the folded areas of the front border.

These embossed patterns will subsequently have a breaking effect on said folds whereby the propensity of the borders of the piece of cloth to return to their original folded state will be reduced, compared to the situation where no such embossing was carried out.

Now, FIG. 5 illustrates a subsequent process step in which the rear border of the piece of cloth 30 has been introduced between the subjacent conveyor 1 and the upper conveyor 15, and wherein the upper conveyor 15 is, at least briefly, operated in an opposite direction as shown by the arrow B1, ie opposite the direction A in which the subjacent conveyor 1 advances the piece of cloth 30. Hereby folded edges at the rear edge of the piece of cloth which are folded across the piece of cloth will be straightened as a consequence of the friction that occurs between the piece of cloth 30 and the tape belts on the upper conveyor 15.

In the same process step the brush-like device 24 is lifted for abutment on the underside of the piece of cloth 30 whereby folded edges at the rear border of the piece of cloth 30 are straightened as the rear edge of the piece of cloth 30 is conveyed past the brush-like device 24. The piece of cloth can subsequently be advanced further eg to the rotary ironer 31 outlined in FIG. 5 whereby the rear edge of the piece of cloth 30 is conveyed past the roller 20 which is, during this process, pressed against the rubber roller 10 whereby the rear border of the piece of cloth 30 is also provided with embossed patterns transversally to the folds occurring at the straightened rear edge of the piece of cloth 30.

As will appear, in the process step shown in FIG. 5, the piece of cloth completely covers that part of the subjacent conveyor 1 which is provided with a vacuum box 5. In this position vacuum is supplied, as indicated by the arrows 32, at least to the frontmost end of the subjacent conveyor which is most proximate to the rotary ironer 31 thereby further holding the piece of cloth against the subjacent conveyor 1 on the one hand with a view to ensuring that the piece of cloth is not pulled backwards due to the reverse direction of conveyance B1 of the upper conveyor, and on the other to ensure that the straightened edges on the piece of cloth are further kept in place.

Obviously, the present invention can be exercised in other ways that the one shown in the figures. Thus, conveyors of varying lengths and natures can be used and, in particular as regards the roller 20 for forming embossed patterns on the piece of cloth, it can be replaced by eg an embosser stamp or other embosser device. Moreover, the straightening of front borders on the piece of cloth as well as rear borders folded underneath the piece of cloth can be accomplished by causing differences in the rates of conveyance to occur between the subjacent conveyor 1 and the upper conveyor 15 with a view to obtaining the same effect as described above in connection with the straightening of rear borders of the piece of cloth 30 that are folded across the piece of cloth.

What is claimed is:

1. A method of advancing a substantially rectangular piece of cloth to a cloth treatment apparatus, the piece of cloth having front and rear borders related to direction of advancement, comprising the steps of:

initially spreading out and advancing the piece of cloth in a spread-out state and at a given rate of conveyance between a subjacent conveyor and a superjacent conveyor that abuts on the subjacent conveyor; and at least partially straightening folded edges, if any, on at least one of the front and rear borders of the piece of cloth, in the plane of the piece of cloth prior to the piece of cloth entering said cloth treatment apparatus;

wherein a folded edge on at the least one of the front and rear borders on the piece of cloth is straightened by effecting, at least briefly, a different rate of conveyance between the superjacent and the subjacent conveyors, in a manner so that the folded edge is straightened due to the different rate of conveyance and resulting friction between the piece of cloth and the subjacent and the superjacent conveyors.

2. A method of advancing a substantially rectangular piece of cloth to a cloth treatment apparatus, the piece of cloth having front and rear borders related to direction of advancement, comprising the steps of:

initially spreading out and advancing the piece of cloth in a spread-out state and at a given rate of conveyance between a subjacent conveyor and a superjacent conveyor that abuts on the subjacent conveyor; and at least partially straightening folded edges, if any, on at least one of the front and rear borders of the piece of cloth, in the plane of the piece of cloth prior to the piece of cloth entering said cloth treatment apparatus;

wherein a folded edge on the at least one of the front and rear borders on the piece of cloth is straightened by effecting, at least briefly, a different rate of conveyance between the superjacent and the subjacent conveyors, in a manner so that the folded edge is straightened due to the different rate of conveyance and resulting friction between the piece of cloth and the subjacent and the superjacent conveyors; and wherein edges that are folded across the piece of cloth at the rear border of the piece of cloth are at least partially straightened by the piece of cloth being pulled forward at a rate of conveyance that corresponds to the rate of conveyance of the subjacent conveyor, and, at least briefly, by a reduced rate of conveyance for the superjacent conveyor compared to the rate of conveyance of the piece of cloth.

3. The method of either of claims, 1 or 2, wherein the straightening of folded edges, if any, at the front border of the piece of cloth, is effected by reducing the rate of conveyance of the piece of cloth relative to that of at least one of the subjacent and superjacent conveyors, when the front border of the piece of cloth is pulled between the subjacent and the superjacent conveyors.

4. The method of claim 1, wherein at least those edges on the piece of cloth that have been straightened in the plane of the piece of cloth are subsequently maintained in their straightened state between the superjacent and the subjacent conveyors.

5. A method of advancing a substantially rectangular piece of cloth to a cloth treatment apparatus, the piece of cloth having front and rear borders related to direction of advancement, comprising the steps of:

initially spreading out and advancing the piece of cloth in a spread-out state and at a given rate of conveyance between a subjacent conveyor and a superjacent conveyor that abuts on the subjacent conveyor; and at least partially straightening folded edges, if any, on at least one of the front and rear borders of the piece of cloth, in the plane of the piece of cloth prior to the piece of cloth entering said cloth treatment apparatus;

wherein a folded edge on the at least one of the front and rear borders on the piece of cloth is straightened by effecting, at least briefly, a different rate of conveyance between the superjacent and the subjacent conveyors, in a manner so that the folded edge is straightened due to the different rate of conveyance and resulting friction between the piece of cloth and the subjacent and the superjacent conveyors; and Wherein the straightening of folded edges, if any, that have been folded underneath the piece of cloth at the rear border of the piece of cloth is accomplished the rear border of the piece of cloth being conveyed past a brush device arranged below the subjacent conveyor when the rear border is situated between the superjacent the subjacent conveyors.

6. A method of advancing a substantially rectangular piece of cloth to a cloth treatment apparatus, the piece of cloth having front and rear borders related to direction of advancement, comprising the steps of:

initially spreading out and advancing the piece of cloth in a spread-out state and at a given rate of conveyance between a subjacent conveyor and a superjacent conveyor that abuts on the subjacent conveyor; and at least partially straightening folded edges, if any, on at least one of the front and rear borders of the piece of cloth, in the plane of the piece of cloth prior to the piece of cloth entering said cloth treatment apparatus;

wherein a folded edge on the at least one of the front and rear borders on the piece of cloth is straightened by effecting, at least briefly, a different rate of conveyance between the superjacent and the subjacent conveyors, in a manner so that the folded edge is straightened due to the different rate of conveyance and resulting friction between the piece of cloth and the subjacent and the superjacent conveyors;

wherein at least those edges on the piece of cloth that have been straightened in the plane of the piece of cloth are subsequently maintained in their straightened state between the superjacent and the subjacent conveyors; and wherein the at least one of the front and rear borders of the piece of cloth is embossed transversely to the front or rear borders of the piece of cloth while the respective border is situated between the superjacent and the subjacent conveyors.

7. The method of claim 6, Wherein following embossing of the front border or the rear border, the piece of cloth is secured to the surface of the subjacent conveyor by sub-atmospheric pressure supplied from the underside of the subjacent conveyor and to its top surface.

8. An apparatus for advancing substantially rectangular pieces of cloth to a cloth treatment apparatus, the piece of cloth having front and rear borders related to direction of advancement, comprising:

a subjacent conveyor;

a superjacent conveyor, the subjacent conveyor and the superjacent conveyors abutting on each other, and being arranged so that individual pieces of cloth can be advanced in a spread-out state between the conveyors;

means for operating the subjacent and superjacent conveyors; and means for at least partially straightening folded edges on at least one of the front and rear borders of the piece of cloth, in such a manner that the folded edges are at least partially straightened in the plane of the piece of cloth prior to the piece of cloth entering the cloth treatment apparatus;

wherein the means for at least partially straightening folded edges on the at least one of front and the rear borders of the piece of cloth comprises a control for the means for operating the subjacent and the superjacent conveyors, effective to operate the subjacent and the superjacent conveyors at different rates, at least briefly.

9. An apparatus for advancing substantially rectangular pieces of cloth to a cloth treatment apparatus, the piece of cloth having front and rear borders related to direction of advancement, comprising:

a subjacent conveyor;

a superjacent conveyor, the subjacent conveyor and the superjacent conveyors abutting on each other, and being arranged so that individual pieces of cloth can be advanced in a spread-out state between the conveyors;

means for operating the subjacent and superjacent conveyors; and means for at least partially straightening folded edges on at least one of the front and rear borders of the piece of cloth, in such a manner that the folded edges are at least partially straightened in the plane of the piece of cloth prior to the piece of cloth entering the cloth treatment apparatus, the means for at least partially straightening folded edges on the at least one of the front and the rear borders of the piece of cloth comprising a control for the means for operating the subjacent and the superjacent conveyors, effective to operate the subjacent and the superjacent conveyors at different rates, at least briefly;

a rear border detection device for detecting the presence of the rear border of a piece of cloth between the subjacent and the superjacent conveyors; and means for operating the superjacent conveyor at a lower rate of conveyance than the subjacent conveyor when the rear border of the piece of cloth is detected by the border detection device, whereby folded edges, if any, at the rear border of the piece cloth, are straightened across the piece of cloth.

10. The apparatus of claim 9, further comprising a brush device arranged below the subjacent conveyor, said brush device being displaceable between a first, inactive position and a second, active position in which it extends from the underside of the subjacent conveyor to a top surface thereof; and means for shifting the brush device from its second, active position when the rear border of the piece of cloth is detected by the rear border detection device so that folded edges, if any, underneath the piece of cloth at the rear border of the piece of cloth are straightened.

11. An apparatus for advancing substantially rectangular pieces of cloth to a cloth treatment apparatus, the piece of cloth having front and rear borders related to direction of advancement, comprising:

a subjacent conveyor;

a superjacent conveyor, the subjacent conveyor and the superjacent conveyors abutting on each other, and being arranged so that individual pieces of cloth can be advanced in a spread-out state between the conveyors;

means for operating the subjacent and superjacent conveyors; and means for at least partially straightening folded edges on at least one of the front and rear borders of the piece of cloth, in such a manner that the folded edges are at least partially straightened in the plane of the piece of cloth prior to the piece of cloth entering the cloth treatment apparatus, the means for at least partially straightening folded edges on the at least one of the front and the rear borders of the piece of cloth comprising a control for the means for operating the subjacent and the superjacent conveyors, effective to operate the subjacent and the superjacent conveyors at different rates, at least briefly;

a feed conveyor for advancing pieces of cloth to the subjacent and the superjacent conveyors and preceding the subjacent and the superjacent conveyors relative to the direction of conveyance of the piece of cloth;

a front border detection device for detecting the presence of the front border of a piece of cloth between the subjacent and the superjacent conveyors; and means for operating the feed conveyor, at least briefly, at a lower rate of conveyance than the rate of conveyance of the subjacent conveyor when the front border of the piece of cloth is detected by the front border detection device, whereby folded edges, if any, at the front border of the piece of cloth are straightened.

12. An apparatus for advancing substantially rectangular pieces of cloth to a cloth treatment apparatus, the piece of cloth having front and rear borders related to direction of advancement, comprising:

a subjacent conveyor;

a superjacent conveyor, the subjacent conveyor and the superjacent conveyors abutting on each other, and being arranged so that individual pieces of cloth can be advanced in a spread-out state between the conveyors;

means for operating the subjacent and superjacent conveyors; and means for at least partially straightening folded edges on at least one of front and rear borders of the piece of cloth, in such a manner that the folded edges are at least partially straightened in the plane of the piece of cloth prior to the piece of cloth entering the cloth treatment apparatus, the means for at least partially straightening folded edges on the at least one of the front and the rear borders of the piece of cloth comprising a control for the means for operating the subjacent and the superjacent conveyors, effective to operate the subjacent and the superjacent conveyors at different rates, at least briefly; and an embosser device arranged after the means for completely or partially straightening folded edges, if any, on the at least one of the front or rear borders of the piece of cloth, said embosser device being arranged to emboss the piece of cloth in such a manner that embossed patterns extend at least across and substantially transversally to those edges of the piece of cloth that have been straightened.

13. An apparatus for advancing substantially rectangular pieces of cloth to a cloth treatment apparatus, the piece of cloth having front an rear borders related to direction of advancement, comprising:

a subjacent conveyor;

a superjacent conveyor, the subjacent conveyor and the superjacent conveyors abutting on each other, and being arranged so that individual pieces of cloth can be advanced in a spread-out state between the conveyors, the subjacent conveyor extending farther than the superjacent conveyor in the direction of conveyance of the piece of cloth;

means for operating the subjacent and superjacent conveyors; and means for at least partially straightening folded edges on at least one of the front and rear borders of the piece of cloth, in such a manner that the folded edges are at least partially straightened in the plane of the piece of cloth prior to the piece of cloth entering the cloth treatment apparatus, the means for at least partially straightening folded edges on the at least one of the front and the rear borders of the piece of cloth comprising a control for the means for operating the subjacent and the superjacent conveyors, effective to operate the subjacent and the superjacent conveyors at different rates, at least briefly; and means for supplying a subatmospheric pressure from the underside of the subjacent conveyor to its top surface at least in an area of the subjacent conveyor extending beyond the superjacent conveyor.

14. Apparatus according to claim 13, wherein the subjacent conveyor is a tape conveyor comprising a plurality of spaced tapes, the tapes having perforations for transmitting said subatmospheric pressure from the underside of the subjacent conveyor to top surfaces of the tapes.

* * * * *

UNITED STATES PATENT AND TRADEMARK OFFICE

CERTIFICATE OF CORRECTION

PATENT NO. : 6,076,291
DATED : June 20, 2000
INVENTOR(S) : Jorn Munch Jensen

It is certified that error appears in the above-identified patent and that said Letters Patent is hereby corrected as shown below:

Claim 3, column 7,
Line 1, after "claims", delete ",".

Claim 5, column 7,
Line 33, "Wherein" should read -- wherein --.
Line 35, after "accomplished", insert -- by --.
Line 39, before "the subjacent", insert -- and --.

Claim 7, column 8,
Line 4, "Wherein" should read -- wherein --.

Claim 9, column 8,
Line 63, before "border", insert -- rear --.
Line 64,after "piece", insert -- of --.

Claim 12, column 10,
Line 2, before "front", insert -- the --.

Claim 13, column 10,
Line 22, "front an" should read -- front and --.

Signed and Sealed this

Eighteenth Day of September, 2001

*Attest:*

Nicholas P. Godici

NICHOLAS P. GODICI
*Acting Director of the United States Patent and Trademark Office*

*Attesting Officer*